United States Patent [19]

Root

[11] 4,021,869

[45] May 10, 1977

[54] FITTED TOP SHEET AND BLANKET

[76] Inventor: William Edwin Root, 7410 N. Dakin St., Apt. E-302, Denver, Colo. 80221

[22] Filed: Nov. 24, 1975

[21] Appl. No.: 634,785

[52] U.S. Cl. ..... 5/334 C
[51] Int. Cl.[2] ..... A47G 9/00
[58] Field of Search ..... 5/334, 334 R, 334 C, 5/335

[56] References Cited

UNITED STATES PATENTS

| | | | |
|---|---|---|---|
| 2,577,178 | 12/1951 | Bellinger | 5/334 R |
| 2,679,056 | 5/1954 | Simpson | 5/334 R |
| 2,832,967 | 5/1958 | Sobel | 5/334 R |
| 3,181,179 | 5/1965 | Roddey | 5/334 C |
| 3,377,636 | 4/1968 | Di Addario | 5/334 R |

*Primary Examiner*—Paul R. Gilliam
*Assistant Examiner*—Andrew M. Calvert

[57] ABSTRACT

A top sheet or blanket to be fitted on top of a bed having an elastic binding at the bottom edge and around the two bottom corners for securely fitting the sheet or blanket to the bottom of the bed, and also provided with a large fold sewn in the sheet or blanket toward the bottom of the bed, said fold being expandable for foot room to provide comfort to the occupants sleeping in said bed, the folds being further provided with snaps to keep the folded portion of the bed or blanket in a neat position when the bed is not in use.

1 Claim, 3 Drawing Figures

FIG. 1
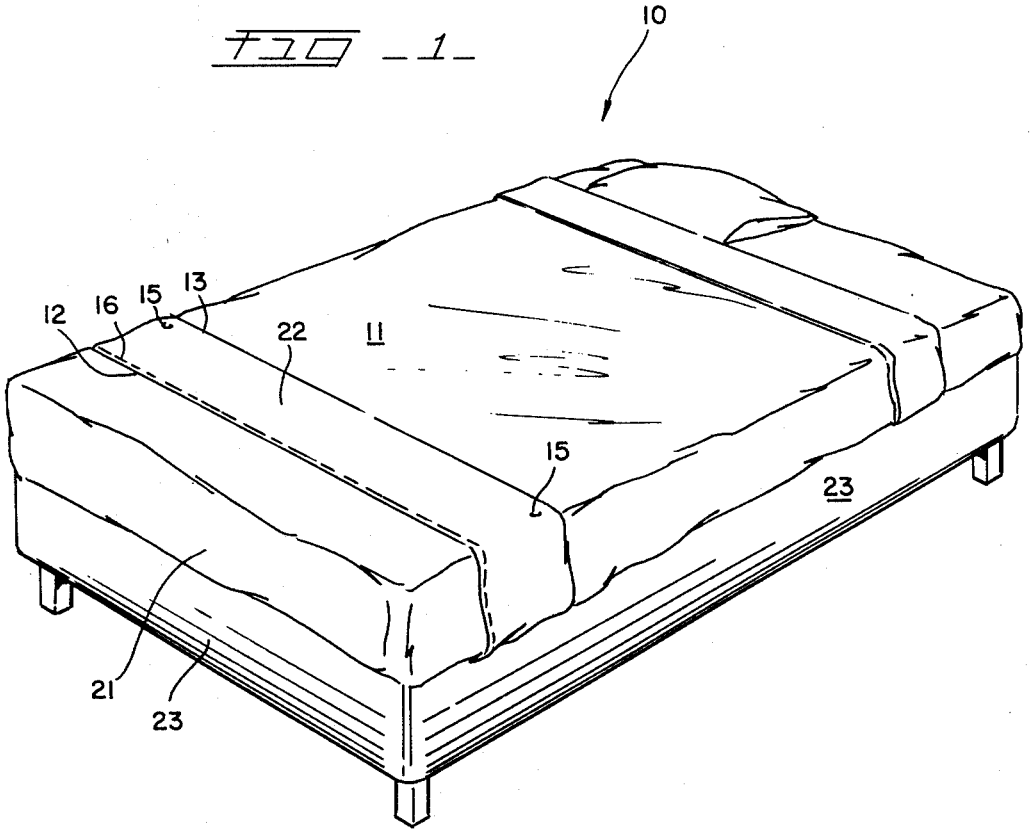
FIG. 2
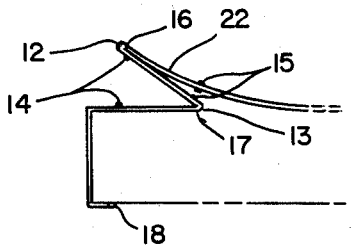
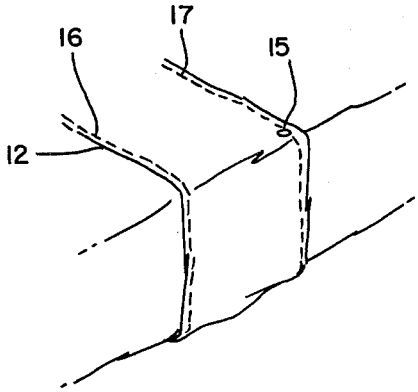
FIG. 3

FITTED TOP SHEET AND BLANKET

BACKGROUND OF THE INVENTION

1. Field of the Invention

This invention relates to a fitted top sheet or blanket for beds which can be securely fastened to the bottom of a bed and which enhance the comfort of a sleeping occupant by providing extra foot room.

2. Description of the Prior Art

Bottom bed sheets are common which are provided with elastic banding around the edges and corners for securely fitting the bottom bed sheet on to a bed. Top bed sheets and blankets, however, are presently available without elastic bindings to be fitted to the bed, so that top sheet and blankets must be draped over the edges and corners of a bed mattress and tucked by hand between the mattress and box spring for holding said sheet and blanket in place. When said top sheets and blankets are tucked in at the bottom and sides of a bed, the occupant of the bed must often loosen the sheet and blanket from their tucked-in positions to provide comfortable foot space toward the foot of the bed, this often causing disheveling of the sheet and blanket with the occupant of the bed sometimes becoming uncovered while sleeping.

SUMMARY OF THE INVENTION

The present invention provides a novel top sheet and blanket for beds with elastic bindings to fit the sheet and blanket snugly to the mattress at the foot of the bed and with a built-in fold of sheet or blanket material toward the foot of the bed for foot comfort of the occupant and with a means to snap the fold in a flat position for neat appearance of the bed when not in use.

It is a feature of the present invention to provide a fitted top sheet and blanket for beds.

A further feature of the present invention provides a fitted top sheet and blanket for beds which is easy to fit on to a bed and will remain positioned in place while in use.

Yet still a further feature of the present invention provides a fitted top sheet and blanket for beds which can be efficiently and economically produced by manufacturers with existing equipment.

Other features of this invention will be apparent during the course of the following description.

BRIEF DESCRIPTION OF THE DRAWINGS

In the accompanying drawings forming a part of this specification, and in which like reference characters are employed to designate like parts throughout the same:

FIG. 1 is a perspective view of a top sheet or blanket in a position on a bed; and FIG. 2 is a cut-away view of the fold for foot room and the elastic binding at the bottom edge of the sheet or blanket; and FIG. 3 is a sectional view of the fold in position when a bed is made.

DESCRIPTION OF THE PREFERRED EMBODIMENT

Referring now to the drawings in detail, there is illustrated a preferred form of the fitted top sheet and blanket constructed in accordance with the principles of the present invention and which is designated generally in its entirety by the reference numeral 10 and which is comprised of fabric material 11, a top fold 12, a bottom fold 13, top fold snaps 14, bottom fold snaps 15, top fold stitching 16, bottom fold stitching 17, and elastic binding 18 at the bottom edge and corners of the fitted sheet or blanket.

The fabric material 11 consists of conventional bed sheet or blanket material, such as linen, denim, cotton, wool, and so forth, and is manufactured to the size or dimensions required to fit given size of bed mattress, with the top portion 20 of the sheet or blanket provided in a conventional manner and with the bottom or foot edge 21 of the sheet or blanket provided with an elastic binding 18 around the bottom edge and bottom corners.

A fold 22 is provided in the fabric material 11 toward the foot of the bed 23 with the top fold 12 being creased in the sheet or blanket and stitched in place by the top fold stitching 16 and with the bottom fold 13 being stitched in place by bottom fold stitching 17. The top fold snaps 14 provided along the top fold 12 and consist of any conventional available snaps. The bottom fold snaps 15 are provided along the length of the bottom fold 13 and are also of conventional available snaps. The elastic binding 18 is also of conventional elastic material attached by conventional stitching to the bottom edge and corners of the sheet or blanket.

To make up the bed 23, the bottom sheet is placed on the bed mattress in the conventional manner. The top sheet or blanket 11 is placed on the mattress by stretching the elastic binding 18 the bottom of the sheet or blanket around the bottom of the mattress at the foot of the bed, and the fold 22 is positioned at the foot of the bed by snapping the bottom fold snaps 15 and the top fold snaps 14 in place. The bed spread may then, of course, be positioned over the bed in a conventional manner for a decorative appearance. Upon getting ready to retire, an individual unsnaps the top fold snaps 14 and the bottom fold snaps 15 to provide a loose fold into which the feet of a sleeping occupant would be comfortably interposed.

It is to be understood that the form of this invention as shown and described is to be taken as a preferred example thereof, and that this invention is not to be limited to the exact arrangement of parts described in the description or illustrated in the drawings as changes thereto in the details thereof pertaning to size, shape and arrangement of parts thereof are envisioned within the scope of the invention without departing from the novel concepts of the invention.

Having thus described the invention, what is claimed is:

1. A fitted top sheet or blanket for beds, the sheet or blanket manufactured to fit any size bed, the invention comprising, in combination:

elastic binding conventionally stitched around the bottom edges and corners of a sheet or blanket for snugly securing a sheet or blanket to the bottom edge and bottom corners of a bed mattress; and a stitch-in fold toward the bottom of said sheet or blanket for foot comfort, said fold being (provided) conventionally stitched laterally across the entire width of said sheet or blanket; and a series of conventional snaps (provided) sewn along the top portion of said fold and along the bottom portion of said fold to hold said fold in place for neat appearance when the bed is made up.

* * * * *